United States Patent [19]

Warren et al.

[11] Patent Number: 4,854,397

[45] Date of Patent: Aug. 8, 1989

[54] SYSTEM FOR DIRECTIONAL DRILLING AND RELATED METHOD OF USE

[75] Inventors: Tommy M. Warren, Coweta; Warren J. Winters, Tulsa, both of Okla.

[73] Assignee: Amoco Corporation, Chicago, Ill.

[21] Appl. No.: 244,770

[22] Filed: Sep. 15, 1988

[51] Int. Cl.[4] ..... E21B 7/04; E21B 44/00; E21B 47/022

[52] U.S. Cl. ..... 175/26; 175/27; 175/45; 175/61

[58] Field of Search ..... 175/24, 26, 27, 45, 175/40; 73/151; 364/420

[56] References Cited

U.S. PATENT DOCUMENTS

| | | | |
|---|---|---|---|
| 3,593,807 | 7/1971 | Klima | 175/27 X |
| 4,040,495 | 8/1977 | Kellner et al. | 175/73 |
| 4,165,789 | 8/1979 | Rogers | 175/27 |
| 4,354,233 | 10/1982 | Zhukovsky et al. | 175/27 X |
| 4,445,578 | 5/1984 | Millheim | 175/45 |
| 4,452,075 | 6/1984 | Bockhorst et al. | 175/45 X |
| 4,463,814 | 8/1984 | Horstmeyer et al. | 175/45 |
| 4,577,701 | 3/1986 | Dellinger et al. | 175/73 X |
| 4,637,479 | 1/1987 | Leising | 175/45 X |
| 4,662,458 | 5/1987 | Ho | 175/27 |
| 4,733,733 | 3/1988 | Bradley et al. | 175/61 X |

*Primary Examiner*—Stephen J. Novosad

*Attorney, Agent, or Firm*—Scott H. Brown; Fred E. Hook

[57] ABSTRACT

A system for directional drilling and related method of use is described herein which utilizes a drillstring suspended within a wellbore with an MWD and downhole turbine or motor connected adjacent a drill bit on a lower end of the drillstring, and with a top drive and/or rotary table connected adjacent an upper end of the drillstring. Within the method, desired limits of drilling associated parameters are inputted into a memory associated with a programmable digital computer. While drilling the wellbore, transmitted values of the drilling associated parameters are inputted into the memory. If the transmitted values are outsude of the desired limits, necessary adjustments are calculated and then made to weight-on-bit (WOB), RPM and/or drillstring azimuthal orientation to bring the transmitted values within the desired limits.

4 Claims, 2 Drawing Sheets

SYSTEM FOR DIRECTIONAL DRILLING AND RELATED METHOD OF USE

BACKGROUND OF THE INVENTION

1. Field of the Invention

The present invention relates to a system used in directional drilling and a related method of use and, more particularly, to such a system and method that uses a programmable digital computer to assist in controlling the drill azimuthal orientation of a string to control the drill bit trajectory.

2. Description of the Prior Art

The trajectory of a rotating drill bit through the earth's subterranean formations is partially determined by a plurality of drilling associated parameters, such as the mineralogy and geological configuration of the subterranean formations, the physical characteristics of the drilling equipment utilized, the type of drilling fluid utilized and the like. Further, the trajectory of the rotating drill bit is partially determined by the azimuthal orientation of the drillstring.

To provide the drilling operator with an understanding of the direction in which the wellbore is progressing, downhole measurement-while-drilling (MWD) tools, which are now commercially available, are utilized to send to the earth's surface for display to the drilling operator the operating parameters of the drill bit, such as RPM, weight-on-bit (WOB) and bit torque, and the wellbore's inclination and direction, usually measured as degrees from True North, and the azimuthal orientation of the drillstring.

That is, it is well known to those skilled in the art that when drilling with a downhole motor that forms a portion of the bottomhole assembly (BHA) which includes one or more axial bends in said assembly wherein the drillbit rotation is provided primarily by the downhole motor such that the drillstring extending from above the motor back to the surface is not rotated except for periodic adjustments to the azimuthal orientation of the bend(s) in the BHA that by applying a rotational force, either in a clockwise or counter clockwise direction, to an upper end of the drillstring it will cause the rotating drill bit connected at a lower end of the drillstring to move in the direction to which the rotation has been applied. This is generally called "steering" the bit.

The rotational force to the drillstring is applied by rotation of the drill rig's rotary table or by a hydraulic or electric power swivel, called a top drive. Initially, the azimuthal orientation of the drillstring is fixed at the surface to start the drill bit in the direction that is desired. Since the drillstring is an elastic system that is constrained at the surface by the drill rig's rotary table or top drive, the drill bit direction changes as the drill bit torque changes. These torque changes occur frequently because of the changes in the applied weight-on-bit (WOB), and changes in the subterranean formation's geological configuration. In order to keep the drill bit moving in the desired azimuthal direction, numerous rotational adjustments need to be applied on an almost constant basis.

Drillstring orientation is accomplished by rotating the rotary table or top drive in a stepwise manner, called "bumping," and/or adjusting the weight-on-bit (WOB). This stepwise rotation of the rotary table is time consuming and produces a gross adjustment. Any adjustments to weight-on-bit (WOB) often results in the drill bit operating at less than optimum weight-on-bit (WOB), which has been found to greatly reduce the drill bit's penetration rate. Additionally, the above described step wise adjustments produce a wellbore path that includes a series of crooked steps. Thus, wellbore completions, cementing, logging tool runs and the like can be more difficult or impossible.

There is a need for a method of directional drilling which can be used to substantially reduce the time involved in having to effectuate the changes in drillstring orientation, which will be done in a smooth manner so that a smoother wellbore path will occur all while maintaining a proper weight-on-bit (WOB).

SUMMARY OF THE INVENTION

The present invention has been developed to overcome the foregoing deficiencies and meet the above described needs. Specifically, present invention is a system and related method of use for directionally drilling a wellbore. A drillstring is suspended within a wellbore with a downhole data collection and transmission device, such as a measurement-while-drilling MWD tool, and a drill bit rotation device, such as a downhole positive displacement motor (PDM) or turbine connected adjacent a drill bit at a lower end of the drillstring. A bent sub, bent housing on the drill bit rotation device, or an eccentric stabilizer is used to initiate the curved portion of the wellbore. Also, a drillstring rotation device is connected adjacent the upper end of the drillstring with such device optionally being an electrically, hydraulically or direct drive driven rotary table or a hydraulic or electric power swivel or top drive.

In a method of the present invention, desired limits of drilling associated parameters are inputted into a memory associated with a programmable digital computer. While drilling the wellbore, values of these drilling associated parameters are transmitted from the MWD tool to the programmable digital computer. Within the programmable digital computer, the transmitted values are correlated and compared to the desired limits. If the transmitted values are outside of the limits, adjustments to weight-on-bit (WOB), RPM and/or drillstring azimuthal orientation are made under control of the programmable digital computer. With the use of the programmable digital computer, the transmitted values can be continuously and accurately compared to the desired limits, and proper adjustments can be made resulting in a smoother wellbore path and the maintenance of the proper weight-on-bit. (WOB).

DETAILED DESCRIPTION OF THE PREFERRED EMBODIMENTS

The system and related method of use of the present invention includes the use of a downhole data collection and transmission device, a drillstring rotation device, and a drill bit rotation device. Each such device can be any commercially available device as will be described.

The downhole data collection and transmission device can be any commercially available downhole measurement-while-drilling (MWD) tool that transmits data to the surface either by mud pulse or electromagnetic energy. Such MWD tools are available from Schlumberger, Gearhart, Teleco, Sperry Sun, Baker and Smith. Also, downhole measurement devices that operate at the surface can be used; however, a downhole device is preferred because of data accuracy. Regardless of what type of device is used, at a minimum the device needs to transmit an accurate measurement of wellbore inclination, azimuthal direction (from True North, for example) and drillstring orientation. Any other transmitted data, referred to as drilling associated parameters, such as drill bit torque, RPM, WOB, downhole temperature, downhole pressure and the like, can be used if available.

The system and related method of use described herein can be utilized with any commercially available electric, hydraulic or diesel driven drill rig having hydraulic and/or cable draw works. Also, the drill bit and/or drillstring used to drill the wellbore in accordance with the present invention can be rotated by an electric, hydraulic or direct drive rotary table, electric or hydraulic power swivel or top drive, as is well known to those skilled in the art. Further, a downhole drive mechanism, such as a downhole positive-displacement-motor (PDM) or turbine, is preferably used to rotate the drill bit because of desired high drill bit rotation speed and high deviation controllability. And, a power swivel or top drive is preferred to rotate the drillstring because of the smooth and accurate adjustments in azimuthal orientation of the drillstring that can be achieved.

Figure 1:
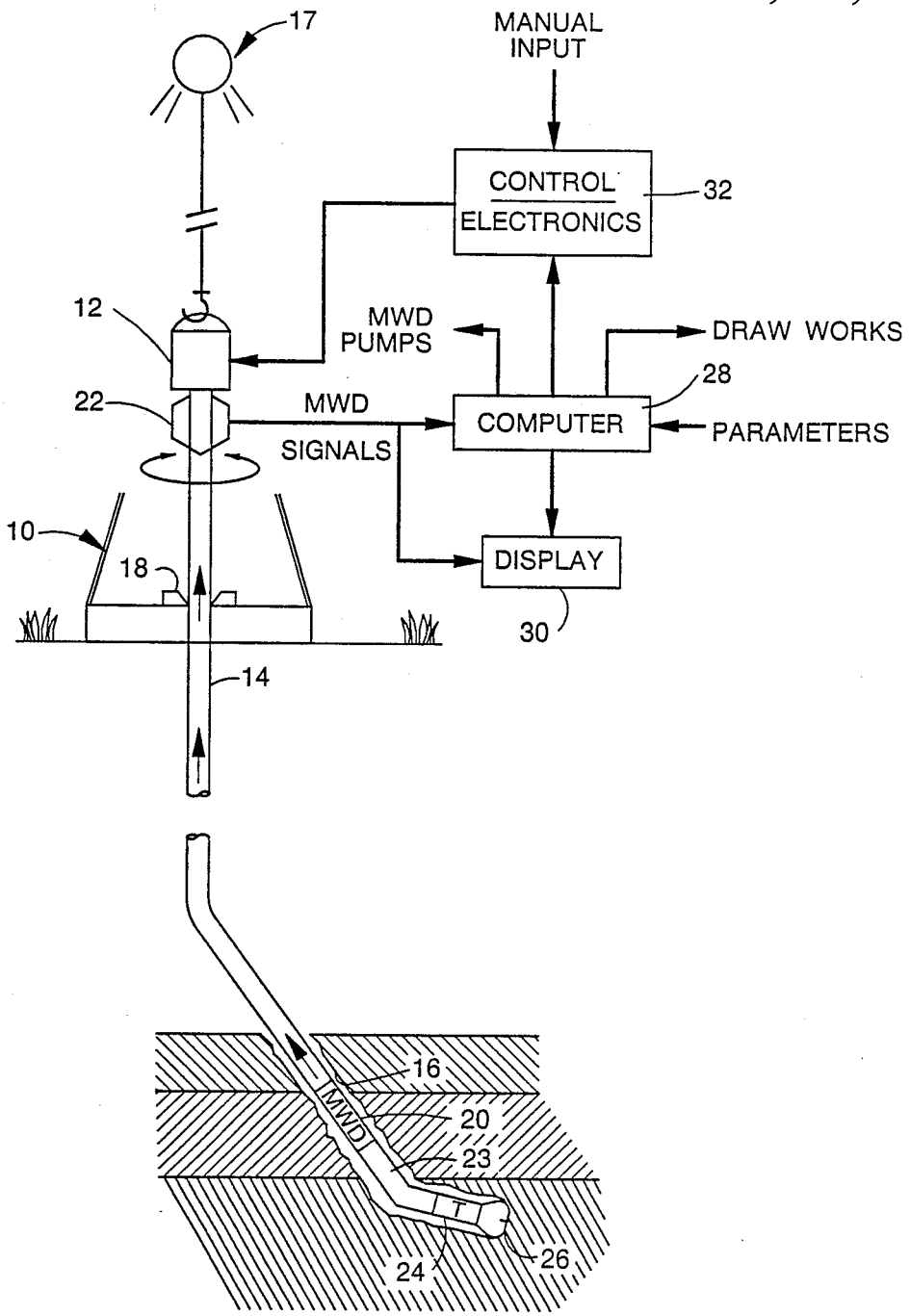
FIG. 1 is a semidiagramatic front elevational view of a directional wellbore being drilled through the earth and which includes a block diagram of major system components, for use in one embodiment of the present invention, for controlling the wellbore's path.

An embodiment of the present invention is shown in FIG. 1, wherein a drilling rig 10 includes a top drive or power swivel 12 connected to an upper end of a drillstring 14 which is suspended within a wellbore 16 by a drawworks 17. A rotary table, including pipe slips, 18 can be utilized to maintain proper drillstring orientation in connection with or in place of the top drive or power swivel 12. A downhole telemetry measurement and transmission device 20, commonly referred to as a measurement-while-drilling (MWD) tool is connected to a lower end of the drillstring 14 and transmits drilling associated parameters to the surface by mud pulse or electromagnetic transmission. These signals are received at the surface by a data receiving device 22, which is commercially available and necessary with use of an MWD tool. A bent sub 23 is connected to the drillstring 14 adjacent the MWD tool 16 for assistance in drilling an inclined wellbore. A bent housing on a motor or eccentric stabilizers can also be used. A downhole drill bit rotation device 24, such as a positive-displacement-motor (PDM) or downhole turbine, is connected to the drillstring and a drill bit 26 is connected to the lower end thereof.

The downhole signals received by the data reception device 22 are provided by direct electrical or indirect cable, fiberoptic or radio link to a memory associated with a programmable digital computer 28. The programmable digital computer can be located at the wellsite or remotely linked to the wellsite, and should be capable of processing MWD signals sent at least once every five minutes, preferably one every 30 seconds. An IBM PC-AT or equivalent has been found to be adequate. The memory usually is a random-access-memory (RAM) which acts as a data storage and buffer. The signals are also sent to a display device 30, which can be a CRT visual display device, a hard copy log printing device, one or more gauges and/or visual and audial alarm systems. The programmable digital computer 28 is operatively connected to controls of the draw works 17 to control WOB, and to a control mechanism 32 associated with power swivel or top drive 12 and/or of the rotary table 18, to control the rotation of the drillstring and drill bit. If a downhole motor or turbine is used, the computer 28 may also be operatively connected to a control mechanism associated with the drilling rig's mud pumps to control the rotation of the drill bit.

In the operation of one embodiment of the present method, desired limits of the drilling associated parameters to be monitored are inputted into the memory associated with the programmable digital computer 28. This inputting operation can be accomplished by tape drive and/or by a keyboard, located on site or remotely linked, to input desired limits of weight-on-bit (WOB), torque, RPM, drillstring inclination and azimuthal direction, and other parameters found useful in directional drilling. A first drillstring orientation is chosen and the drillstring is locked into place by preventing the rotary table 18 and/or power swivel or top drive 12 from rotating. Drilling is commenced and the MWD signals are sent to the computer 28 and display device 30. Computer logic within the programmable digital computer compares and correlates the desired limits for the drilling associated parameters. If any one of the values is outside the desired limits then the programmable digital computer's logic causes an alarm to be activated so corrective action can be taken. Preferably, the logic causes the draw works 17, top drive or power swivel 12, rotary table 18 and/or mud pumps to be adjusted by a preselected amount or increment. Most preferably, the logic calculates the optimum adjustment necessary to the devices so that the parameter values are brought back to within the desired limits.

As can be readily understood by those skilled in the art, by having the computer constantly receiving and correlating the transmitted drilling associated parameters with the desired limits and then having the computer constantly effectuate the necessary and optimum changes to bring those parameters back within the desired limits, then a smoother wellbore path will be automatically drilled.

Figure 2:
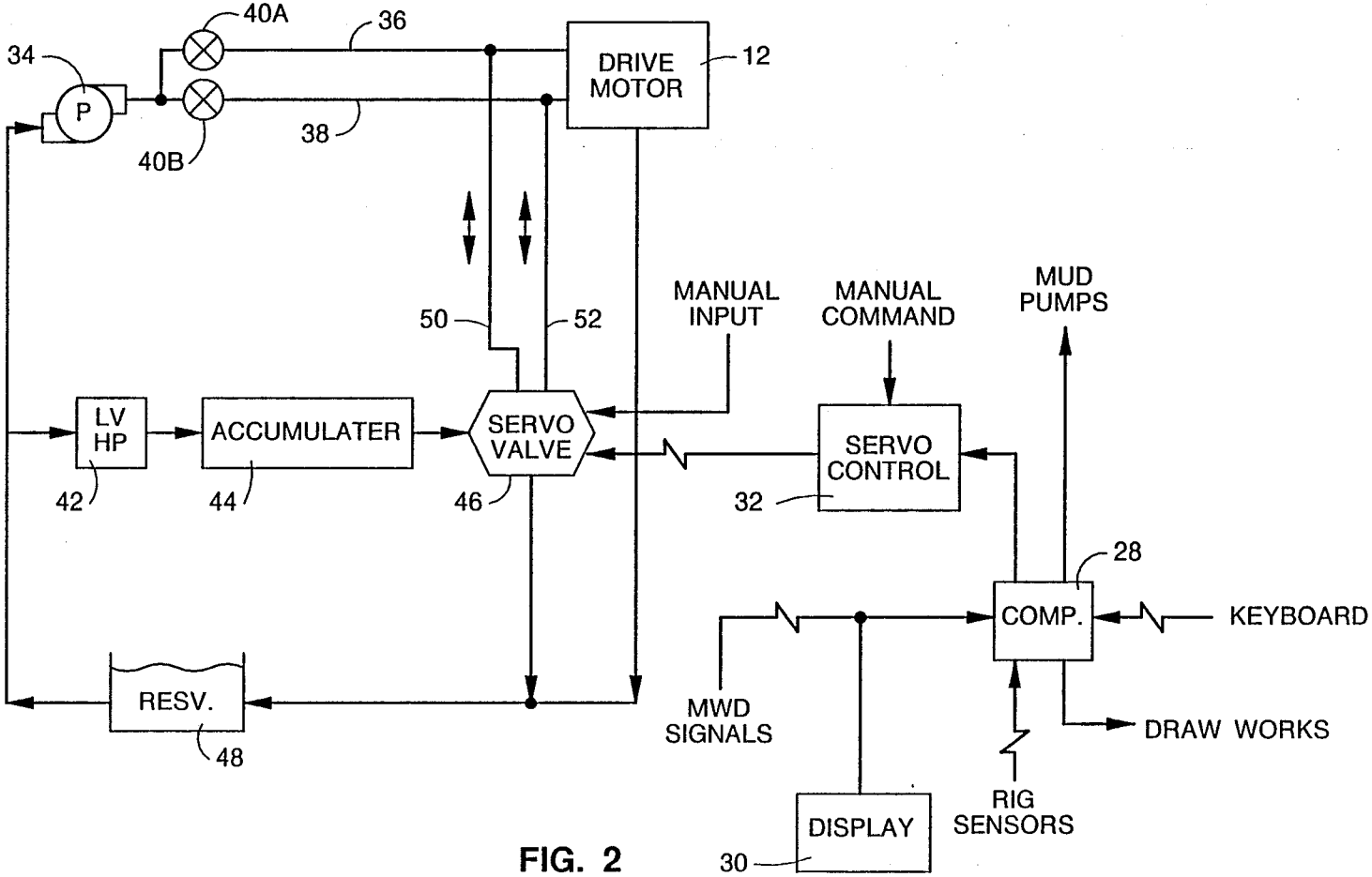
FIG. 2 is a block diagram of major system components utilized in controlling the drillstring orientation in accordance with one embodiment of the present invention.

One embodiment of a hydraulic control mechanism that can be utilized with a hydraulically driven power swivel, top drive and/or rotary table, and which can easily be adapted for use with the same devices but electrically driven will be described below and is shown in FIG. 2. Usually, the hydraulic motors that are used in power swivels or top drives 12 are positive displacement motors (PDM) with hydraulic fluid provided by a hydraulic pump 34 through two-way lines 36 and 38, each with back check valves **40*a* and 40*b*. A low-volume, high-pressure pump 42, fluid accumulator 44 and servo valve 46 acting as a system is fed hydraulic fluid from a fluid reservoir 48, that also supplies hydraulic fluid to the pump 34, as is well known to those skilled in the art. The servo valve 46 causes hydraulic fluid to either be forced alternately through supply lines 50 and 52 to cause the drive motor 12 to rotate forward or reverse. The quantity of hydraulic fluid provided and operation of the valve 46 dictates the rotation speed, direction, and locked/stopped position. The servo valve 46 can also be operated to circulate hydraulic fluid at an exact rate to offset any fluid leakage within the motor 12** to cause the drillstring to remain stationary.

The servo valve 46 is controlled by solenoids, motors and the like from the programmable digital computer 32 in accordance with the previously described method. In the event that a programmable digital computer 28 is not used or fails, then manual control of the servo valve 46 can be accomplished by the operator watching a display 30 and turning a potentiometer (not shown) to rotate the drillstring clockwise or counterclockwise to keep the proper wellbore direction.

Another embodiment of the system of the present invention and related method of use involves using the programmable digital computer to make calculations needed to determine the correct changes needed in a manner such that the operator inputs the drillstring inclination and azimuthal direction desired at certain well depth. Physical characteristics associated with the drillstring configuration, such as drillstring thickness, weight of drill collars, elasticity, drill bit performance, and the like, are also inputted into the programmable digital computer. The computer then calculates the best values of the parameters needed to reach the desired depth, inclination and direction in the shortest distance drilled. These calculations are based on the equations of a circular arc in three-dimensional space. In this method the empirical correction to the calculations to account for such things as local geological effects, bit walk effects, hydraulic effects and other unquantifiable effects due to local conditions are easily and constantly made. As a result, these corrections are based on an actual measured response of the drillstring assembly within the previous few feet and does not rely on any predictive or assumed model.

Whereas the present invention has been described in particular relation to the drawings attached hereto, it should be understood that other and further modifications, apart from those shown or suggest herein, may be made within the scope and spirit of the present invention.

What is claimed is:

1. A method of controlling the path of a drillstring during directional drilling operations that utilizes downhole data collection and transmission means and drill bit rotation means connected adjacent a drill bit on a lower end of the drillstring, and with drillstring rotation means connected adjacent an upper end of the drillstring, the method comprises:

(a) inputting permitted limits of variance from a preselected drillstring azimuthal direction into memory means associated with a programmable digital computer;

(b) controlling the drillstring rotation means to maintain a fixed desired drillstring azimuthal orientation, and while drilling the wellbore utilizing the drill bit rotation means, transmitting a value of the downhole drillstring azimuthal direction to memory means associated with the programmable digital computer;

(c) if the transmitted value of step (b) is outside of the permitted limits, calculating within the programmable digital computer the required direction and degrees of rotation of the drillstring required to bring the transmitted value within the permitted limits; and (d) utilizing the programmable digital computer to momentarily activate the drillstring rotation means to incrementally rotate the drillstring in accordance with step (c).

2. An automatic directional drilling system for use in drilling operations that utilizes downhole data collection and transmission means and drill bit rotation means connected adjacent a drill bit on a lower end of the drillstring, and with drillstring rotation means connected adjacent an upper end of the drillstring, the system comprises:

means associated with a programmable digital computer for storing permitted limits of variance from a selected drillstring azimuthal direction and comparing received value of the downhole drillstring azimuthal direction;

means associated with the programmable digital computer for calculating any required quantity and direction of rotation of the drillstring required to bring the received value within the desired limits; and means associated with the programmable digital computer for controlling the drillstring rotation means to effectuate the calculated quantity and direction of rotation of the drillstring.

3. An automatic directional drilling system for use in drilling operations utilizing a downhole data collection and transmission means and drill bit rotation means connected adjacent a drill bit on a lower end of a drillstring, and with hydraulic drillstring rotation means connected adjacent the upper end of the drillstring, the system comprises:

means associated with a programmable digital computer for storing permitted limits of variance from a selected drillstring azimuthal direction and comparing received values of the downhole drillstring azimuthal direction;

means associated with the programmable digital computer for calculating any required direction and degrees of rotation of the drillstring required to bring the received values within the permitted limits; and means associated with the programmable digital computer for controlling hydraulic servocontrol valve means associated with the drillstring rotation means to effectuate the calculated direction and incremental degrees of rotation of the drillstring.

4. A directional drilling system for use in drilling a wellbore having a desired inclination and azimuthal direction and utilizing a drillstring suspended within a wellbore with downhole data collection and transmission means and drill bit rotation means connected adjacent a drill bit on the lower end of the drillstring, and with hydraulic drillstring rotation means connected adjacent an upper end of the drillstring, the system comprises:

means associated with a programmable digital computer for storing a desired inclination and final azimuthal direction of the wellbore, physical characteristics of the drillstring, and transmitted values of drilling associated parameters;

means associated with the programmable digital computer for calculating desired changes to weight-on-bit (WOB), RPM and/or drillstring azimuthal orientation necessary for the wellbore to achieve the desired inclination and final azimuthal direction; and means associated with the programmable digital computer for controlling hydraulic servocontrol valve means associated with the drillstring rotation means for incrementally adjusting the drillstring azimuthal orientation and/or drill bit rotation means to effectuate the calculated drilling changes.

* * * * *